US005282435A

United States Patent [19]

Chapman

[11] Patent Number: 5,282,435

[45] Date of Patent: Feb. 1, 1994

[54] MECHANICAL SYSTEM FOR CONTROL OF A FREE FLOATING DOCK

[76] Inventor: Harold S. Chapman, Box 298 Bragg Creek, Alberta, Canada, T0L 0K0

[21] Appl. No.: 982,632

[22] Filed: Nov. 27, 1992

[51] Int. Cl.[5] ..... B63B 35/44

[52] U.S. Cl. ..... 114/263; 405/219

[58] Field of Search ..... 114/263, 293, 230; 405/218, 219, 220

[56] References Cited

U.S. PATENT DOCUMENTS

| | | | |
|---|---|---|---|
| 3,050,947 | 8/1962 | Burton | 405/219 |
| 3,683,838 | 8/1972 | Godberson | 114/263 |
| 4,300,854 | 11/1981 | Sluys | 405/219 |

*Primary Examiner*—Michael S. Huppert
*Assistant Examiner*—Thomas J. Brahan
*Attorney, Agent, or Firm*—George H. Dunsmuir

[57] ABSTRACT

A device for maintaining docks or other floating bodies at a given distance from and orientation to the shore by means of a ratchet assembly hinged on the side of the dock closest to shore, and a line attached to two guides, such as pulleys, on the underside of the dock. When the level of the water varies, the device maintains the dock at the same distance from the new waterline as it was from the old, in the following manner: the line is anchored at one end on shore and at the other to a bottom anchor beyond the farthest point the dock will extend to at lowest water level. Tension in the line pushes the dock towards the shore until the ratchet contacts the bottom, where equilibrium is established. If the water falls, the ratchet pushes the dock away from shore and a new equilibrium is established, farther out; this repeats as long as the water falls. If the level rises, the ratchet is raised off the bottom and the dock moves towards shore to a new equilibrium point. This continues as long as the water rises. Guides are configured so as to minimize rotational movement.

9 Claims, 4 Drawing Sheets

MECHANICAL SYSTEM FOR CONTROL OF A FREE FLOATING DOCK

INTRODUCTORY DESCRIPTION OF THE INVENTION AND PRIOR ART

This invention is a simple and unique solution to an age-old problem, that of a floating dock being beached by drops in water level. Especially in places where such dropping is a frequent occurrence, this inexpensive and automatic device will be welcome. Not only does it move the dock away from shore as the water falls, but moves it back as the water rises; and maintains a consistent distance between the shallow end of the dock and the waterline, so that a connector like a walkway or vehicle transport bridge of a given length can be appropriately used as a bridge to the dock under all conditions.

The invention operates by means of two forces:

(1) imparted by a ratchet attached to the shallow end of the dock and resting on the bottom, which pushes the dock away from shore;

(2) imparted by a line running on a guide such as a pulley attached to the lower side of the deep end of the dock, which pushes the dock towards shore. The line is anchored in deeper water and on shore, and as such provides a guide for the dock to move directly towards or away from shore when the water level varies.

As will be made clear in the following specification, the balance between these two forces maintains the dock at a consistent distance from the water/shore boundary, or waterline, no matter where this waterline moves to as the water level varies.

The prior art searched has shown nothing close to the present invention. U.S. Pat. No. 3,683,838, Godbersen, employs a line attached below the dock, but the method of attachment and purpose of the line have no relation to force pushing the dock towards shore; there the dock is pulled manually, and requires an operator to perform this, unlike the present invention. Plus no ratchet is employed. Canadian patent No. 1,138,721, Sluys, employs two parallel lines driven by a motor on shore; again no ratchet.

It is an object of the present invention to provide a device for maintaining a floating body at a consistent distance from a boundary between the liquid in which the body floats and a solid mass bordering the liquid, where the solid mass extends under the liquid from this border, made up of a ratchet, attached to the floating body on the side nearest the solid mass, and a means of applying a continuous force onto the floating body towards the boundary.

It is a further object that this ratchet exerts a horizontal force on the floating body away from the border equal and opposite to the force being exerted towards the boundary, so that the floating body reaches an equilibrium.

It is a further object that this device shall function to regain this equilibrium after the absolute level of the liquid changes relative to the solid mass in the following manner: in the case of liquid level falling, the horizontal force away from the boundary exerted by the ratchet increases in proportion to the decrease in upwards supporting vertical force supplied by the liquid as its level falls; the floating body responds to this increment of additional horizontal force by moving away from the boundary, opening the angle of attachment of the ratchet to the floating body and hence lifting the end of the ratchet farthest from the floating body off the solid mass; then the continuous force on the body pushing it towards shore causes the floating body to move towards the boundary. Thereafter the ratchet contacts the solid under the floating body and re-establishes the equilibrium, such that the floating body is incrementally farther from any fixed point on the solid mass beyond the boundary than it was before the liquid level fell, but is the same distance from the boundary as it was before the liquid level fell, because the boundary has also moved incrementally away from the solid mass. This process shall repeat for as long as the liquid level continues to fall.

It is a further object of the functioning of the present device that in the case of the liquid level rising the floating body is lifted incrementally relative to the solid, lifting the lower end of the ratchet off the solid under the liquid; the continuous force on the body pushes the floating body towards the boundary; the lower end of the ratchet contacts the solid under the liquid at a new point closer to a fixed point on the solid mass, and equilibrium is re-established. This process will repeat as long as the liquid level rises.

It is a further object of the present invention to provide a device for maintaining a dock at a consistent distance from a boundary between the water the dock is floating in and a shore of the water, and also in a consistent rotational orientation to this shore, in situations where the water level varies, and where the angle of descent of the bottom under the dock is relatively constant; this device is comprised of:

(a) a ratchet attached to the side of the dock nearest the shore, this ratchet being an assembly similar to a short ladder, with two vertical legs and two supporting cross-bars; and made of some material which will maintain its strength when submerged in water for long periods, such as steel or iron;

(b) a hinge assembly attaching the top of each leg to the dock; situated so that the legs extend downwards farther than the bottom of the edge of dock nearest the shore; this hinge assembly being disassembleable so the ratchet can be removed from the dock when necessary, such as to beach the dock at a change of seasons;

(c) a first anchor on the shore, above the highest waterline;

(d) a second anchor on the bottom, farther from the shore than the dock;

(e) two guide means, such as pulleys, attached to the underside of the dock, one being situated near the end of the dock near the shore and the other near the end of the dock farther from shore, such that a line between the two guides would be essentially perpendicular to the shore; said guides being constructed so as to permit disengagement or replacement of a line run through them;

(f) a line through the guides and attached to the anchor on shore at one end and a chain at the other, such that the chain is attached to the anchor on the bottom and is long enough to reach to the surface during high water levels for replacement of the line; this line being pulled relatively tight at installation and its tension being occasionally maintained by adjusting the line length at the shore anchor;

(g) an optional catwalk or extendable bridge on the side of the dock nearest the shore.

A further object of the present invention is that the guides described in "e" above will function as a guiding means to impart forces on the floating body, or dock, parallel to the boundary, or waterline; such forces helping prevent the floating body or dock from rotating or otherwise changing orientation relative to the boundary or shore.

A further object of the invention is to provide a device as just described, with the additional feature that the vertical legs, or members, or the ratchet can be extended to accommodate different angles of descent of the bottom under the dock at different water levels, so as to maintain an essentially same distance between the waterline and the edge of the dock near the shore.

It is a further object that the ratchet can function as a simple ladder for dock access from the water.

To the inventor's knowledge there is no prior art that solves the problem of controlling the distance and orientation of a floating body in like manner; for this reason the reader is advised that the contexts discussed in this introduction and the more detailed description to follow are by example only and in no way are intended to limit the scope of the appended claims.

DETAILED DESCRIPTION OF THE INVENTION

For this description, refer to:

FIGS. 6A, 6B, 6C, and 6D, being schematic side views of ratchet action.

Figure 1:
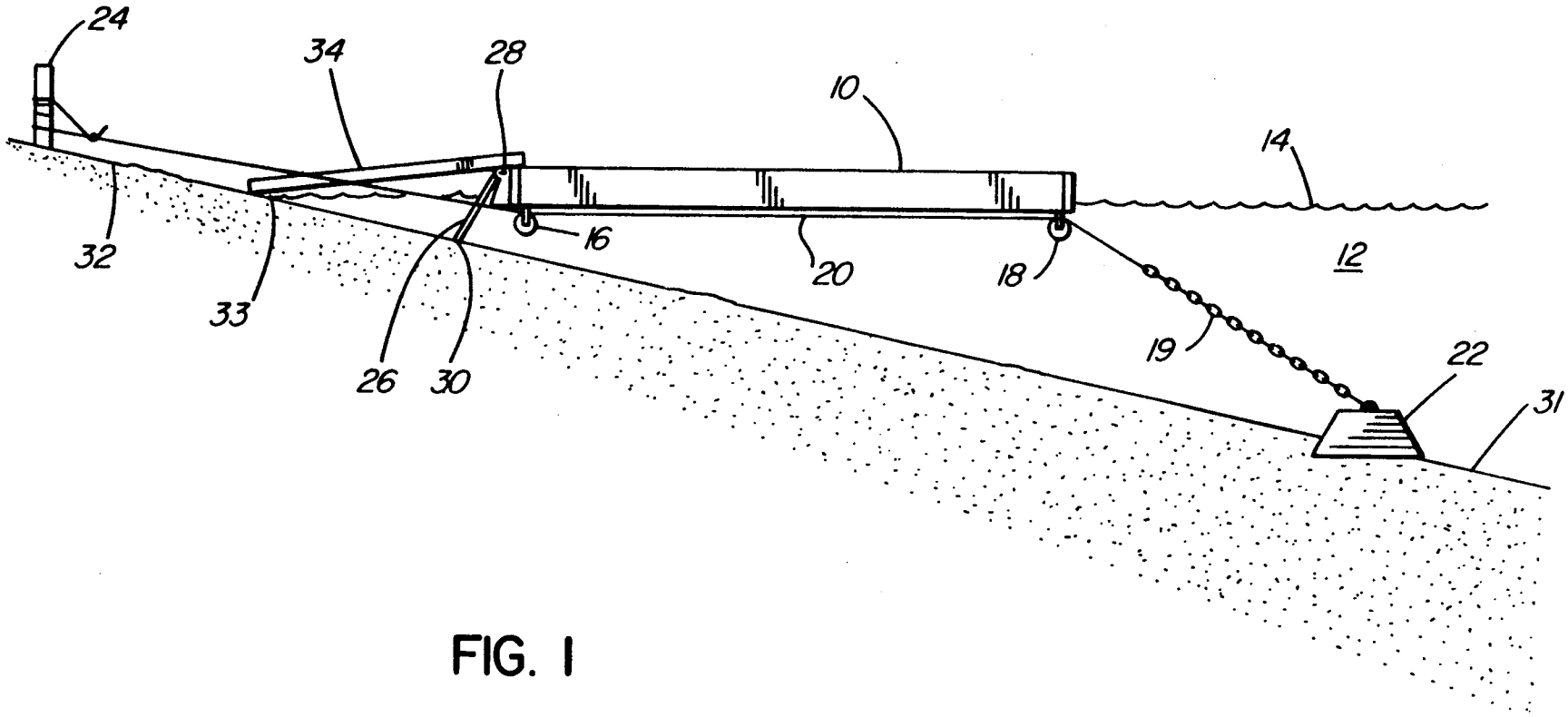
FIG. 1 is a side view of the invented dock controller, with dock.

For this example of the invented device, referring to FIG. 1, a dock 10 floats in water 12. The water level is at 14. Two pulleys are attached to the bottom of the dock 10; the shoreward one 16 and the deep water one 18. A line 20 passes over the pulleys. It is attached to anchor 22 on the bottom 31 in deep water, and shore anchor 24 on shore 32. This deep water anchor 22 is far enough out from shore 32 to be past the farthest extension of the dock 10 at the lowest water level expected to be encountered (not shown). A ratchet 26 touches the bottom at 30 and is attached to the dock 10 at hinge 28. Optional walkway 34 connects dock 10 to the shore 32.

In equilibrium, which FIG. 1 can be presumed to demonstrate, water level 14 is not changing, and the dock 10 is stationary. Tension in line 20 has been previously established by pulling line 20 taut when attaching it to the shore anchor 24. Accordingly there is a horizontal component of the force imparted by the line 20 on the deep end pulley 18; this force pushes the pulley 18 shoreward, and hence the attached dock 10 is also pushed shorewards. This would beach the dock 10 were it not for the ratchet 26, which contacts the bottom at point 30 and exerts an equal opposing horizontal force at its hinge 28. The net effect is that the dock 10 does not move to or from the shore 32 when the water level 14 is stable. Optional bridge 34 can be brought from shore 32 or extended from dock 10.

It is important also that the dock 10 will be restrained in any tendency to move parallel to the shore 32 that might be imparted from wave or water motion or pushing from attached craft or craft arrival or exit. This is accomplished by the fact that, in this example, as seen on FIGS. 2–5, the ratchet 26 is composed of two vertical members 40 and 42 and two horizontal members 44 and 46. So horizontal restraint parallel to the shore is imparted to the dock 10 at hinges 48 and 50 seen on FIG. 3, as well as at pulleys 16 and 18, seen on FIG. 1, where the tension on line 20 will have a tendency to resist sideways movement.

Figure 6A:
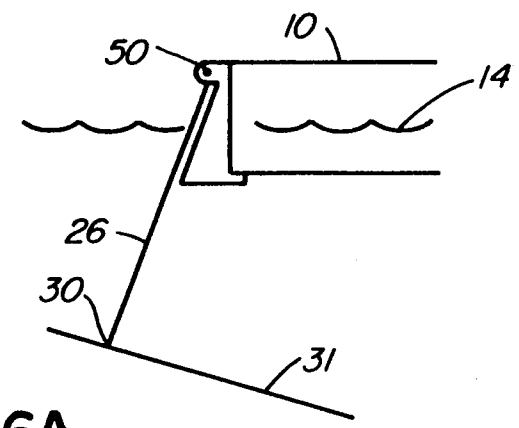
Figure 6B:
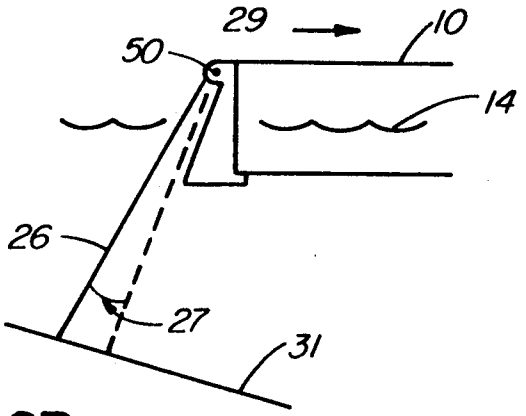
Figure 6C:
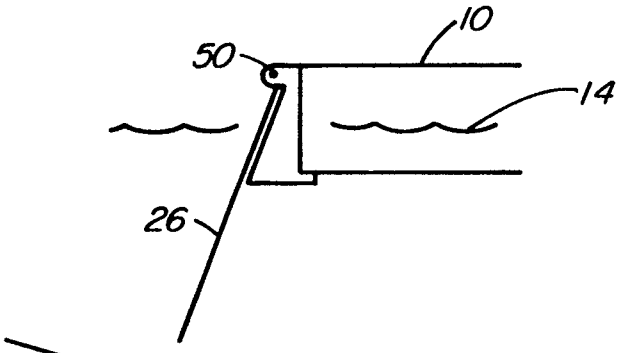
Figure 6D:
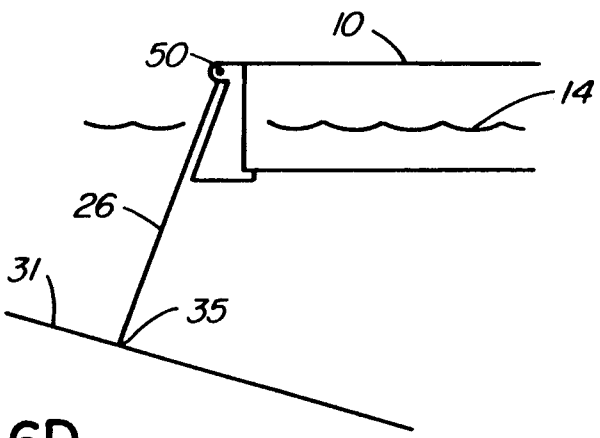

Functioning of the device when the water level 14 falls is as follows: referring to FIG. 6A, as the water level 14 falls relative to the dock 10, the buoyant upwards force of the water will decrease relative to the pushing downwards force of gravity, and the downwards component of the force on ratchet hinge 50 will increase. As this occurs, since the ratchet 26 is contacting the bottom 31 at point 30, the horizontal force away from the shore on the dock 10 at hinge 50 will increase. As seen in FIG. 6B, the dock 10 will move away from the shore in the direction indicated by arrow 29 above dock 10, thus opening the hinge 50 angle by a small additional amount generally indicated as 27, and lifting the ratchet 26 off the bottom 31 a small amount. Thereafter by its own weight ratchet 26 will swing down towards the deeper water to the position shown in FIG. 6C; at this time it is not contacting the bottom 31. Meanwhile since there is now no counteracting force, the previously described shorewards force on the pulley at 18, shown on FIG. 1, moves the dock 10 towards shore and the ratchet 26 contacts the bottom 31 at point 35, as seen in FIG. 6D. Point 35 is slightly further from shore than was point 30. If the water level 14 does not continue to fall, the dock 10 maintains its position as previously described, in equilibrium between the two forces. If the water level 14 falls further, steps shown in FIGS. 6A through 6D are repeated and the dock 10 gradually moves away from shore.

In the case of rising water levels, the process is essentially reversed. Using FIG. 6D as a starting point, with ratchet 26 contacting bottom 31 at point 35, if the water level 14 rises the dock 10 will be lifted and the ratchet 26 will no longer contact the bottom 31, as shown in FIG. 6C. Pushed by the tension of line 20, seen on FIG. 1, against pulley 18, the dock 10 will move towards shore 32. The ratchet 26 will remain in the hanging position shown in FIG. 6C until it contacts the bottom 31 again, whereupon the shorewards motion of the dock 10 will cease, in position 6A. If the water level 14 rises no more, the dock 10 will stay in this position. If the water level 14 rises further, the dock 10 will move towards shore again. Thus the dock 10 will maintain the same distance from waterline 33, shown on FIG. 1, no matter where this waterline is established, as long as the angle of descent of the bottom 31 is relatively consistent. Thus bridge 34 can be extended from dock 10 to shore 32 at any water level. Note also that this same distance maintained between the shoreward end of the dock 10 and the waterline 33 can be varied by making vertical members 40 and 42 of the ratchet 26 as seen on FIGS. 3–5 to be shorter or longer; shorter vertical members will result in dock 10 reaching equilibrium relatively closer to shore 32; longer relatively farther. And though in this example the ratchet 26 is not constructed so to have such variability of vertical members' lengths available while in use, it would be no difficult matter to attach the entire assembly of the ratchet 26 to a sliding bracket so it could be raised or lowered and so vary the equilibrium distance from shore; or to achieve such variability by some other known means, such as extendable tubular legs.

In this example pulleys 16 and 18 on FIG. 1 are to be fashioned so as to facilitate disengaging the line 20 for maintenance or replacement or to beach the dock 10 according to seasonal needs. Ratchet 26 may be removed for dock beaching by removing hinge pins 48 and 50, FIG. 5. The line 20, FIG. 1, will be slacked during beaching, by disconnecting it from the shore anchor 24.

Figure 2:
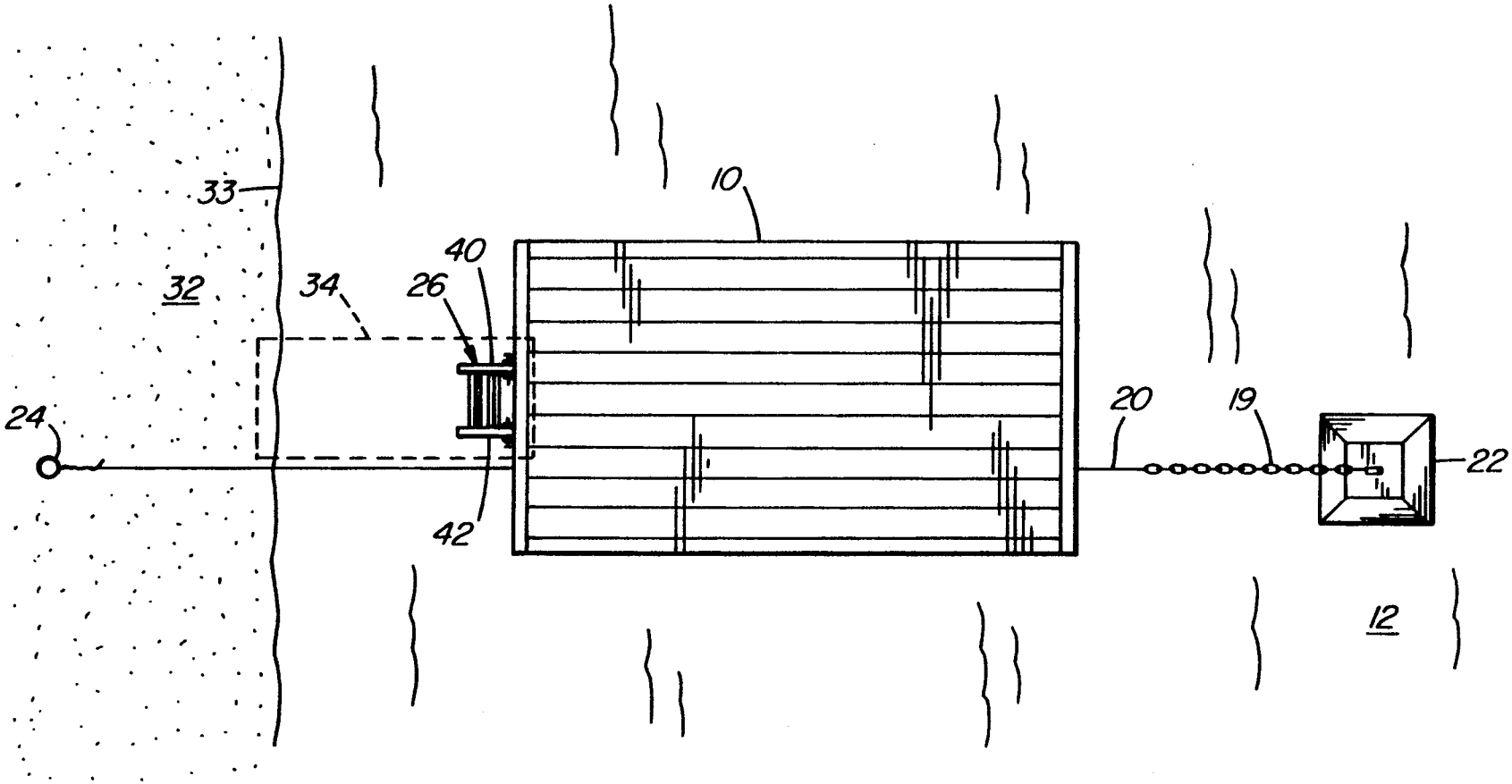
FIG. 2 is a top view of the invented dock controller, with dock.
Figure 3:
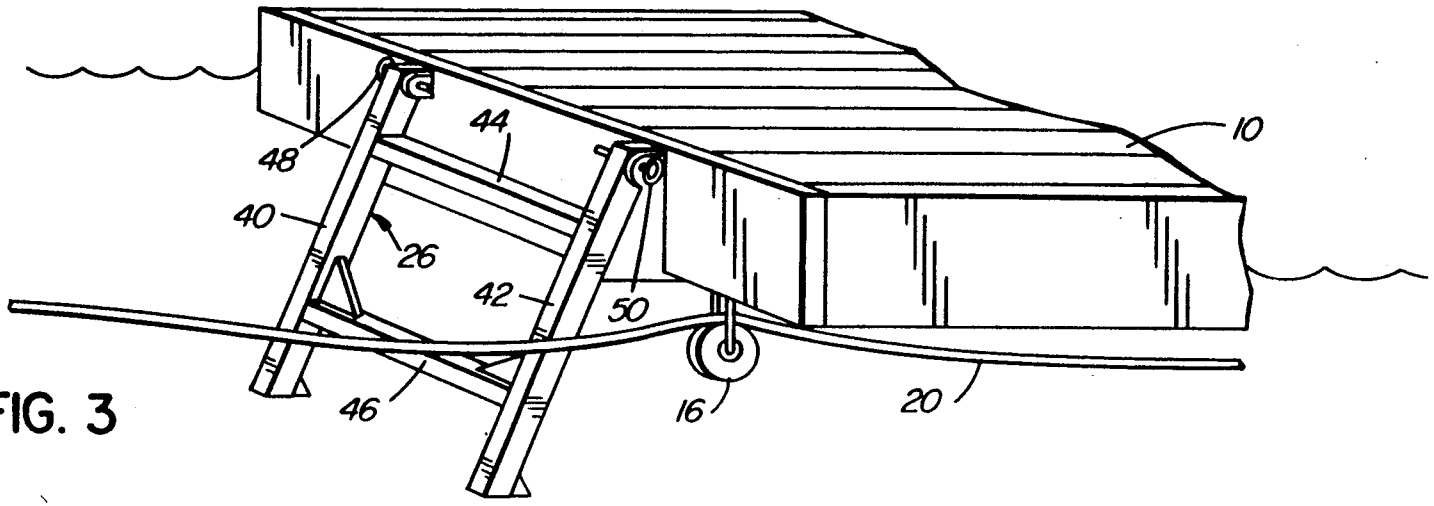
FIG. 3 is a perspective view of the shore end of dock with invention.
Figure 5:
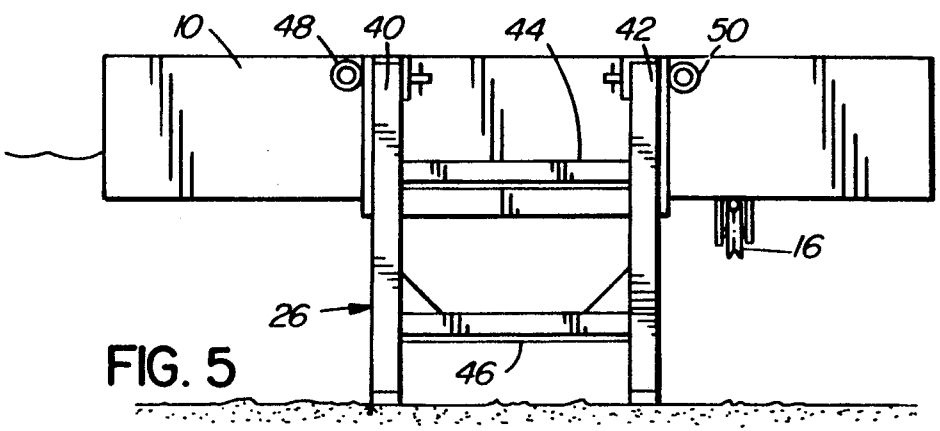
FIG. 5 is a front of the shore end of dock with invention.
Figure 4:
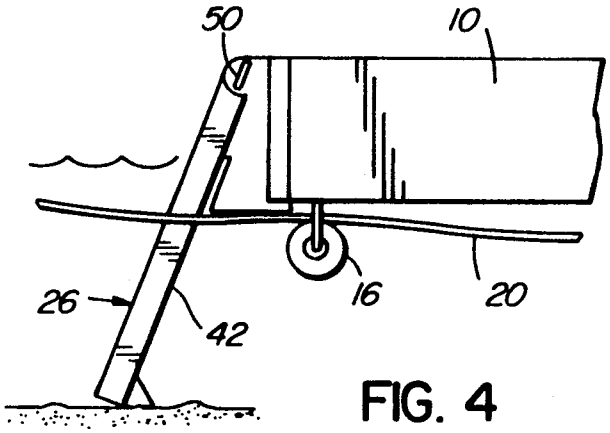
FIG. 4 is a side view of the shore end of dock with invention.

As shown on FIGS. 1 and 2, a chain 19 comprises the portion of the line 20 nearest deep anchor 22. This chain 19 is to be long enough to allow for its extension to the water surface 14 to replace the line 20 during high water levels, should replacement become necessary.

Finally, it may be noted in particular that the use of pulleys to illustrate the guide means in this example is not meant to unduly limit the invention, as other guide means such as "I" pins or curved brackets may be more suitable in certain applications.

The foregoing is by way of example only, and the scope of the invention should be limited only by the appended claims.

The embodiments of the invention in which an exclusive property or privilege is claimed are defined as follows:

1. A device for maintaining a floating body at a consistent distance from a boundary between the liquid in which the body floats and a solid mass bordering said liquid, where the solid mass extends under the liquid from said border, comprising:

(a) a ratchet attached to the floating body on the side nearest the solid mass, said ratchet extending downwards into the liquid far enough so that if the floating body is moved towards the boundary the ratchet will contact the solid under the liquid before any portion of the floating body contacts said solid;

(b) means of applying a continuous force onto the floating body towards the boundary.

2. A device according to claim 1, where the ratchet exerts a horizontal force on the floating body away from the boundary between the solid mass and the liquid equal and opposite to said continuous force, so that the floating body reaches an equilibrium in which it moves neither away from nor towards the boundary.

3. A device according to claim 2, which functions to regain the equilibrium after the absolute level of the liquid changes relative to the solid mass in the following manner: in the case of the liquid level falling:

(a) the horizontal force away from the boundary exerted by the ratchet increases in proportion to the decrease in upwards supporting vertical force supplied by the liquid as the level of said liquid falls;

(b) the floating body responds to this increment of additional horizontal force by moving away from the boundary, opening the angle of attachment of the ratchet to the floating body and hence lifting the end of the ratchet farthest from the floating body off the solid mass;

(c) said continuous force causes the floating body to move towards the boundary;

(d) the ratchet contacts the solid mass under the floating body and re-establishes the equilibrium, such that the floating body is incrementally farther from any fixed point on the solid mass beyond the boundary than it was before the liquid level fell, and moreover is the same distance from the boundary as it was before the liquid level fell, because the boundary has moved incrementally away from the solid mass;

and in the case of the liquid level rising:

(e) the floating body is lifted incrementally relative to the solid, lifting the lower end of the ratchet off the solid under the liquid;

(f) said continuous force pushes the floating body towards the boundary; and (g) the lower end of the ratchet contacts the solid under the liquid at a new point closer to a fixed point on the solid mass, and equilibrium is re-established

4. A device according to claim 1 where the ratchet is attached to the floating body by means of a hinge.

5. A device according to claim 1, where the ratchet is fashioned so it can be extended to various lengths below the floating body.

6. A device according to claim 1, where said continuous force is comprised of:

(a) one or more guide means attached to the floating body, at least one of which is attached farther from the boundary than the ratchet;

(b) a first anchor on the solid mass, situated so that it will not be covered by liquid within the range of the normal variance of the absolute level of the liquid relative to the solid mass;

(c) a second anchor situated in the liquid such that even at the lowest level of the liquid relative to the solid mass said anchor will be farther from the boundary than the floating body, and below the level of the guide means situated farthest from the boundary;

(d) a line guided by the guiding means and attached at one end to said first anchor and at the other to said second anchor, such line being pulled relatively tight when first attached and whenever it shall become relatively slack thereafter.

7. A device according to claim 6, said guide means acting to impart forces on the floating body parallel to the boundary, such forces helping prevent lateral movement of the floating body relative to the boundary and so helping maintain a constant orientation of the floating body relative to the boundary.

8. A device for maintaining a dock at a consistent distance from a waterline, said waterline being a boundary between water the dock is floating in and a shore of the water, in situations where the water level varies, comprising:

(a) a ratchet, attached to a side of the dock nearest the shore, the ratchet being composed of:

(i) one or more vertical members with or without supporting cross-members, composed of material which will maintain its strength when submerged in water for long periods;

(ii) a hinge assembly attaching the top of each vertical member to the dock; such attachment to be situated so that the legs extend downwards farther than the bottom of the dock nearest the shore;

(b) means of applying a continuous force onto the dock towards the waterline.

9. A device as in claim 8, in which said continuous force is an apparatus comprised of:

(a) a line;

(b) one or more guide means attached to the dock;

(c) a first anchor on shore; and (d) a second anchor in the water farther from the shore than the dock.

* * * * *